United States Patent [19]

Pasquarette, Jr. et al.

[11] Patent Number: 4,679,653

[45] Date of Patent: Jul. 14, 1987

[54] HIGHLY MANEUVERABLE INSULATED MAN LIFTING AERIAL CRANE FOR USE IN SERVICING OVERHEAD HIGH-VOLTAGE ELECTRICAL TRANSMISSION LINES

[75] Inventors: Ernest R. Pasquarette, Jr., Lee's Summit; Stanley G. Crouse, Greenwood, both of Mo.; Ermen Campanella; Franco Boiti, both of Bergamo, Italy

[73] Assignee: Ruco Equipment Company, Inc., Kansas City, Mo.

[21] Appl. No.: 816,851

[22] Filed: Jan. 7, 1986

[30] Foreign Application Priority Data

Sep. 30, 1985 [IT] Italy ..... 67829 A/85

[51] Int. Cl.[4] ..... B66F 11/04

[52] U.S. Cl. ..... 182/2; 52/118

[58] Field of Search ..... 182/2; 52/118, 115; 212/268, 267

[56] References Cited

U.S. PATENT DOCUMENTS

| | | | |
|---|---|---|---|
| 3,212,604 | 10/1965 | Garnett | 182/2 |
| 3,604,533 | 9/1971 | Eckels | 182/2 |
| 3,774,217 | 11/1973 | Bonner | 182/2 |
| 3,891,056 | 6/1975 | Ashworth | 182/2 |

*Primary Examiner*—Reinaldo P. Machado

*Attorney, Agent, or Firm*—Schmidt, Johnson, Hovey & Williams

[57] ABSTRACT

A powerful, highly maneuverable, man-lifting crane has three vertically articulating sections which swivel on a common turret for horizontal positioning, the third or outer section of the group comprising three telescoping, tubular booms wherein the outermost boom is constructed of a dielectric material such as fiberglass for carrying an electrically insulated man-lifting bucket at its outer end. A pair of hydraulic extension and retraction cylinders for the telescoping booms of the third section are both housed internally of the section and are mechanically interconnected and hydraulically coupled in such a way that, upon extension of the third section, the fiberglass boom always extends first and, upon retraction of the third section, the fiberglass boom always retracts last. One of the booms of the third section utilizes an unusually long rod in connection with its hydraulic cylinder unit, which rod is supported against bending and twisting by a unique, sliding support coupled in a lost motion connection with the fiberglass boom. A radio transmitter carried in the lifting bucket enables the workman to control all operating functions of the crane from the bucket itself without creating an electrically conductive path to ground potential through control wires and cables.

27 Claims, 11 Drawing Figures

Boom Extension Ram
Articulation Ram
Triple Ext. Ram
Winch
Secondary Ram
Main Ram
Turrent Rotation Motor
Out Rigger Ext. Ram
Out Rigger
Transmitter
Valve Bank
Engine Stop Start
Engine RPM
Receiver
Remote Controlled Actuators
10
12
14
16
18
20
22
24
26
28
30
32
34
36
40
42
44
46
48
50
52
54
56
58
60
62
64
74
76
178
180
182
184
186
188
190

HIGHLY MANEUVERABLE INSULATED MAN LIFTING AERIAL CRANE FOR USE IN SERVICING OVERHEAD HIGH-VOLTAGE ELECTRICAL TRANSMISSION LINES

FIELD OF THE INVENTION

The present invention relates to a powerful, three-section, highly maneuverable, articulating crane especially suited for lifting service personnel to elevated and hard-to-reach locations to assist them in performing service, installation, and maintenance functions on overhead high voltage electrical transmission lines without risking dangerour electrical shock.

BACKGROUND OF THE INVENTION

Numerous aerial devices have heretofore been provided for elevating workmen to overhead locations for the performance of various work functions, but heretofore all have suffered from a certain lack of maneuverability, strength, freedom from the risk of electrical shock, and lifting power. Accordingly, one important object of the present invention is to provide a man-lifting aerial device which has the power, maneuverability and strength of a heavy-duty, articulating crane, yet is capable of safely maintaining the workmen carried by the bucket of the device electrically insulated from ground potential at all times so that, if desired, the workmen can safely service, maintain and install high voltage, overhead electrical transmission lines and the like, even in awkward, hard-to-reach places.

Pursuant to the foregoing, the present invention contemplates attaching a special, electrically insulated, telescoping third section onto the outer end of two, articulating sections of a crane so that the man-lifting bucket carried by the outer tip end of the insulated section can be maneuvered to virtually any desired location within reach of the crane yet is safety insulated from structures associated with the crane which would otherwise tend to provide an electrically conductive path to ground potential. More specifically, the telescoping third section has three tubular, telescoping booms which are extended and retracted by a pair of internally housed, hydraulic piston and cylinder units mechanically interconnected and hydraulically coupled in such a way that the outermost fiberglass boom of the section always extends first and retracts last, thereby maintaining the lifting bucket at the outer end of the fiberglass boom remote from the two metal booms of the third section during significant periods of use of the machine. A radio transmitter located in the lifting bucket enables the operator to control all maneuvering functions of the crane without electrically conductive cables, wires or other structures which have in the past been necessary from such buckets. Special structural provisions are made internally of the telescoping third section of the crane to avoid undue bending and stress in an unusually long piston rod associated with one hydraulic cylinder of the section.

DETAILED DESCRIPTION OF THE PREFERRED EMBODIMENT

Figure 1:
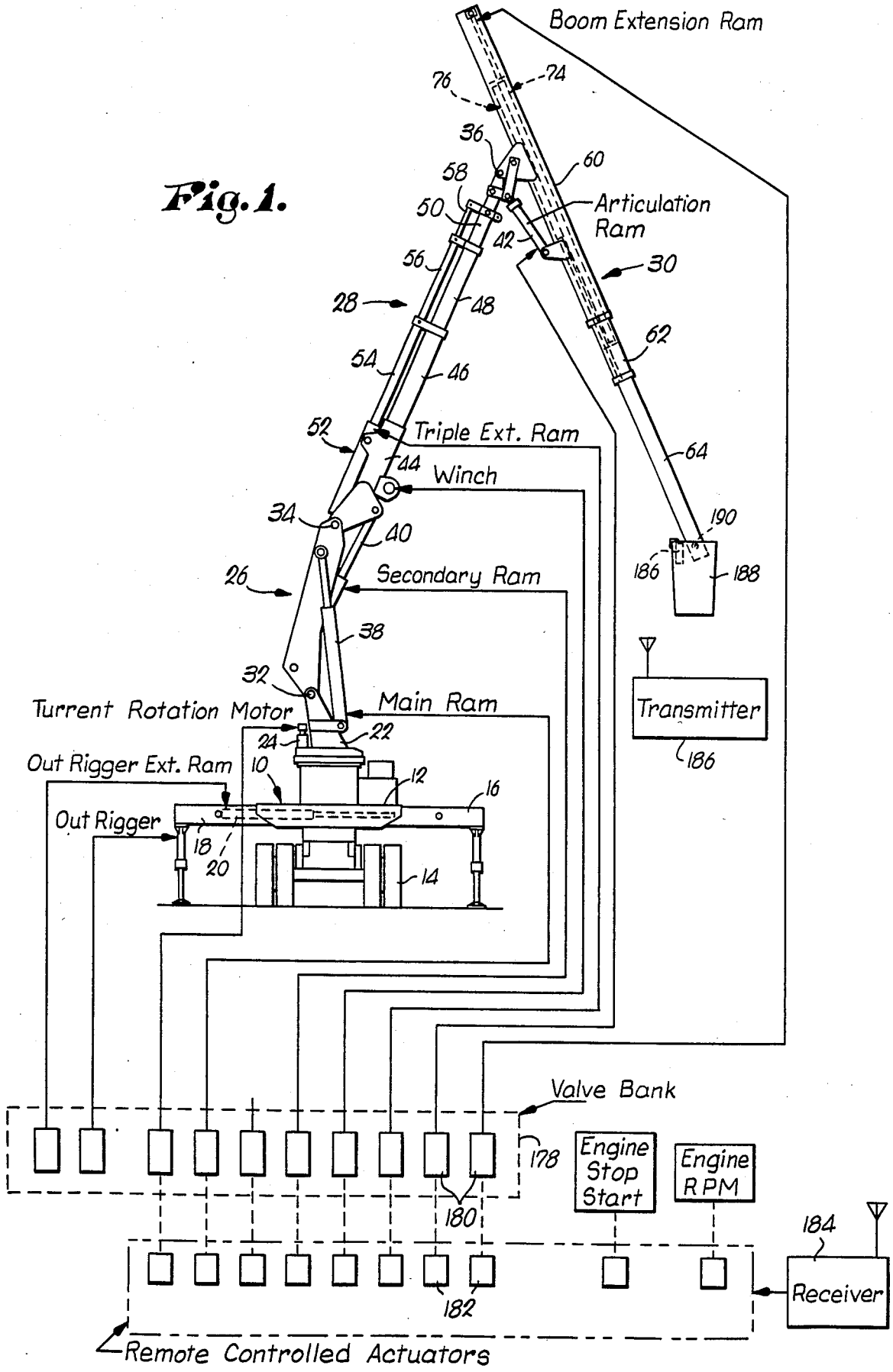
FIG. 1 is a somewhat schematic and diagrammatic illustration of a man-lifting aerial crane device constructed in accordance with the principles of the present invention.

The crane of the present invention as illustrated in FIG. 1 includes a vehicle 10 provided with a generally horizontal, flat base 12 supported for over-the-road travel by ground wheels 14. A pair of stabilizing outriggers 16 and 18 may be extended from opposite sides of the base 12 by a hydraulic power unit 20 for steadying the crane during use.

A turret 22 is mounted on the base 12 for swiveling motion in a horizontal plane about an upright axis, such turret 22 being powered by a suitable hydraulic motor mechanism indicated in part by the numeral 24. In addition, to the turret 22, the crane basically includes three articulating sections denoted broadly by the numerals 26, 28, and 30 respectively which are adapted for up and down swinging movement about respective horizontal axes 32, 34 and 36. The first section 26 is powered in its up and down swinging movement relative to the turret 22 by one or more main hydraulic, extendable and retractable power units 38 connected between the turret 22 on the one hand and the section 26 on the other hand. In turn, the second section 28 is powered in its up and down swinging movement relative to the first section 26 by a hydraulic, extendable and retractable power unit 40 connected between the first section 26 on the one hand and the section 28 on the other hand. A third hydraulic, extendable and retractable power unit 42 is connected between the outer end of the second section 28 on the one hand and the third section 30 on the other hand to provide up and down swinging for the latter. The section 28 itself includes a main boom 44, as well as three telescoping booms 46, 48 and 50 which extend and retract relative to one another, powered in such movements by a three-stage hydraulic, double-acting piston and cylinder unit 52 having telescoping rods 54, 56 and 58 for the booms 46, 48 and 50 respectively.

As shown best in FIGS. 2–8, the third articulating section 30 comprises three tubular, relatively telescoping booms 60, 62 and 64, the boom 60 being the largest in cross-sectional configuration of the three and serving to receive the other two booms 62 and 64 in an internal, stowed position when fully retracted. The booms 60 and 62 are preferably constructed from high strength steel while the outermost boom 64 is constructed from a high strength dielectric material such as fiberglass. Suitable wear pads such as at 66 and 68 between the outer end of boom 60 and the inner end of boom 62 slidably support such two booms for their telescoping movement, while corresponding wear pads such as at 70 and 72 between the second boom 62 and the third boom 64 slidably support such booms for their relative telescoping movement. The wear pads 66–72 are preferably constructed from a suitable synthetic resinous material having anti-friction characteristics.

Figures 2, 3, 4, 5, 6, 7, 8:
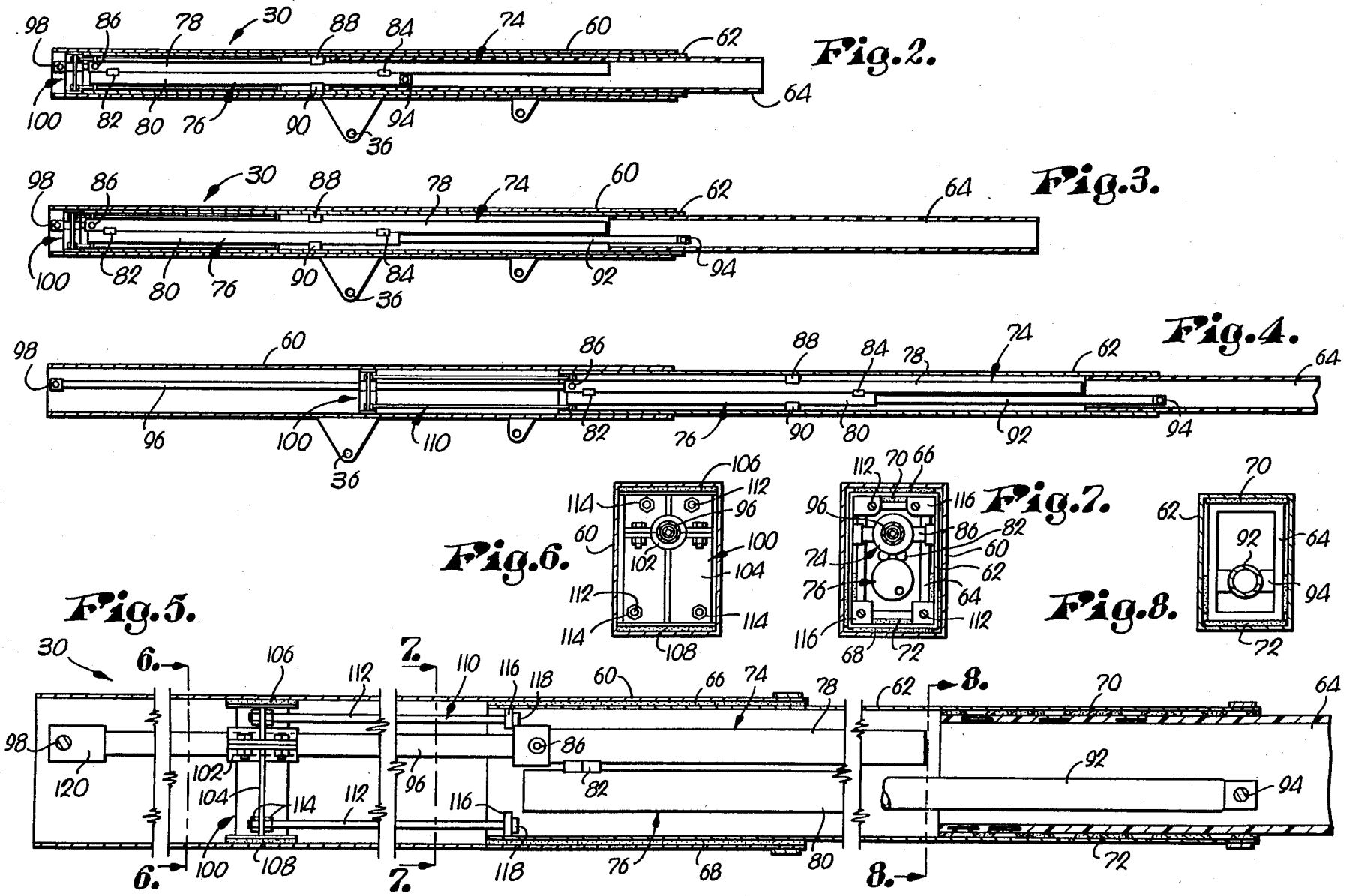
FIGS. 2, 3 and 4 are somewhat enlarged, longitudinal cross-sectional views of the telescoping third section of the crane illustrating the internal construction of such section and the manner in which the outermost fiberglass boom of the third section always extends first and retracts last during extension and retraction of the telescoping third section.
FIG. 5 is a fragmentary, further enlarged, longitudinal sectional view of the telescoping third section illustrating details of construction.
FIG. 6 is a transverse, cross-sectional view thereof taken substantially along line 6—6 of FIG. 5.
FIG. 7 is a transverse, cross-sectional view thereof taken substantially along line 7—7 of FIG. 5.
FIG. 8 is a transverse, cross-sectional view of the third section taken substantially along line 8—8 of FIG. 5.

The booms 60, 62 and 64 are operated in their telescoping movements by a pair of internally housed, fluid pressure, piston and cylinder units 74 and 76. The units 74 and 76 are inverted end-for-end relative to one another and have their cylinders 78 and 80 rigidly interconnected by connectors 82 and 84 located adjacent opposite ends of the cylinder 80 of the power unit 76. The units 74 and 76 are, in turn, rigidly coupled with the second boom 62 by a transversely extending coupling 86 at the rod end of the unit 74, and by additional connecting structures 88 and 90 generally adjacent the midportion of the units 74, 76 as illustrated in FIGS. 2, 3 and 4.

Both cylinders 78 and 80 of the units 74, 76 are housed totally within the second boom 62, but the rod portions of such units extend outwardly beyond the second boom 62 in opposite directions therefrom. In this respect, it will be noted that the rod portion 92 of the unit 76 projects into the third boom 64 and is anchored to the latter generally adjacent the inner end thereof by a transverse anchor 94. On the other hand, the rod portion 96 of the unit 74 projects from the inner end of the boom 62 into the boom 60 and is anchored to the latter adjacent the inner end thereof by a transverse anchor 98.

The unit 74 is unusually long, almost twice the length of the unit 76, and thus at full extension has an unusually long rod portion 96 which would be subject to undesirable and damaging bending moments were it not for the provision of a special, self-adjusting support 100 that engages and supports the midsection of the rod portion 96 upon extension of the latter from the cylinder 78. In this respect, it will be appreciated that the support 100 includes a tubular, central sleeve 102 in the nature of a pair of bolted together, opposite clamp halves that slidably receive the rod portion 96. Although not illustrated in detail, it is to be understood that suitable anti-friction bearing means are desirably provided interiorly of the sleeve to facilitate sliding movement of the rod portion 96 within the sleeve 102 without damaging the finish of the rod portion 96.

The sleeve 102 is supported against transverse shifting by a bracket 104 integral therewith and having a pair of oppositely disposed, flat slide pads 106 and 108 which bear against opposite, normally upper and lower internal wall surfaces of the boom 60. The other lateral side margins of the bracket 104 are spaced a sufficient distance inwardly from the proximal sidewall surfaces of the boom 60 as to avoid the need for sliding wear pads and the like.

The support 100 is coupled with the inner end of the second boom 62 via a lost motion connection broadly denoted by the numeral 110. The lost motion connection 110 includes four elongated, rigid elements all denoted by the numeral 112 and rigidly affixed to the bracket 104 by four nut assemblies 114 or the like at four, rectangularly spaced locations on the bracket 104 as illustrated in FIG. 6. At their opposite ends the elements 112 are slidingly received by four correspondingly spaced shoulders 116 ridigly affixed to the inner face of the second boom 62 adjacent the inner end of the latter. Stops 118 on the terminal ends of the elements 112 beyond the shoulders 116 prevent the elements 112 from pulling completely through and out of the shoulders 116 by abuttingly engaging the inner sides of the shoulder 116 when the support 100 is in a fully extended position as illustrated in FIGS. 4 and 5. On the other hand, when the support 100 is in a fully retracted or stowed position as illustrated in FIGS. 2 and 3, the elements 112 are free to slide through their respective shoulders 116 and extend alongside of the power units 74 and 76 as illustrated for example in FIGS. 2 and 3.

Figure 9:
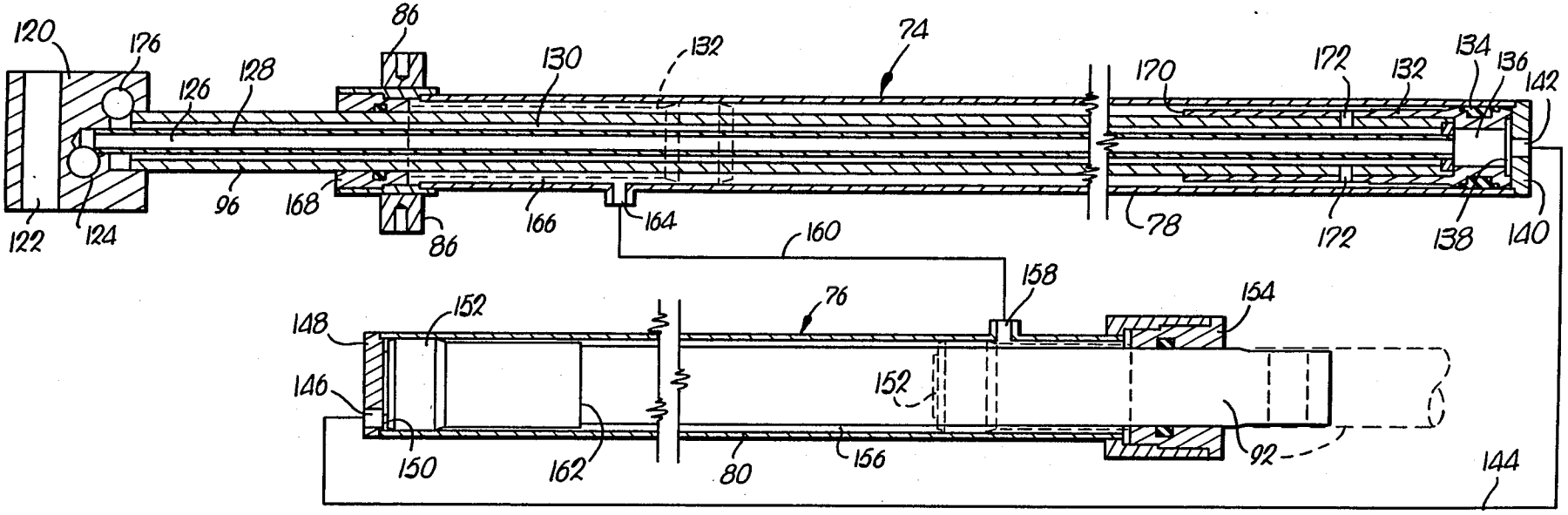
FIG. 9 is an enlarged, longitudinal, cross-sectional view of the two hydraulic piston and cylinder units associated with the third telescoping section illustrating details of internal construction.
Figure 11:
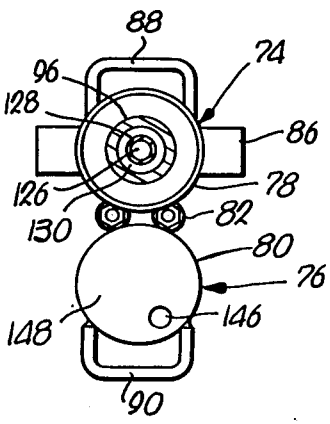
FIG. 11 is a transverse, cross-sectional view thereof taken substantially along line 11—11 of FIG. 10.
Figure 10:
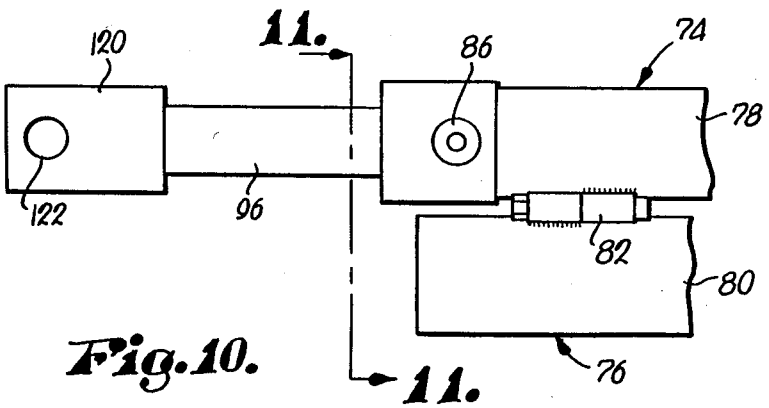
FIG. 10 is a fragmentary, elevational view of the two hydraulic units of the third telescoping section illustrating certain external details of construction.

FIG. 9 illustrates details of construction of the interiors of the power units 74 and 76 and, more particularly, illustrates the configuration and arrangement of components that causes the fiberglass boom 64 to always be extended first and retracted last. In this respect it will be seen that the rod portion 96 of the unti 74 has a block 120 secured thereto at the anchor end thereof, the block 120 having a transverse bore 122 through which the anchor pin 98 extends.

The block 120 also is provided with an internal conduit 124 that is alternately connectable with a source of hydraulic pressure fluid and a drain. In turn, the conduit 124 communicates with a first passage 126 defined within a long, slender tube 128 concentrically housed within the rod portion 96 of unit 74, such rod portion 96 itself being tubular and defining a second annular passage 130 circumscribing the tube 128.

Fixed to the tubular rod portion 96 at its opposite end is a piston 132 having an O-ring type gasket 134 surrounding the same and making sealing engagement with the interior wall surface of the cylinder 78. The piston 132 is itself tubular, having a bore 136 extending axially therethrough for communicating fluid within the passage 126 with an extension chamber 138 defined between the head of the piston 132 and the proximal end wall 140 of the cylinder 78. The extension chamber 138 is shown in its smallest dimensions in FIG. 9 in view of the positioning of the piston 132 directly against the same as a result of the rod 96 being fully retracted.

A port 142 in the end wall 140 of cylinder 78 is connected in flow communication with a line 144 leading therefrom to a port 146 in an end wall 148 of the cylinder 80 associated with the power unit 76. The port 146 communicates directly with an extend chamber 150 in the cylinder 80 defined between the piston 152 on the one hand and the end wall 148 on the other hand. As is the case with extend chamber 138 associated with unit 74, the extend chamber 150 of unit 76 is shown in its smallest size configuration in FIG. 9 as a result of the full retraction of the piston 152 therein. As will be noted, the piston 152 is affixed to the inner end of the rod portion 92 of power unit 76 and makes sealing engagement with the internal wall surfaces of the cylinder 80.

Defined on the opposite side of the piston 152 between the latter and the opposite end eall 154 of the cylinder 80 is a retract chamber 156. A port 158 in the cylinder 80 adjacent the end wall 154 communicates the retract chamber 156 with a line 160 leading from the port 158. A stop collar 162 on the rod portion 92 adjacent the piston 152 is disposed to abuttingly engage the end wall 154 when the rod portion 92 is fully extended as illustrated in phantom lines in FIG. 9 whereby to limit the amount of extension of the rod portion 92. As illustrated, the piston 152 is positioned just short of the port 158 when the rod portion 92 is fully extended so as to leave the port 158 in open communication with the retract chamber 156 defined between the piston 152 and the end wall 154.

The line 160 leading from the port 158 is connected to an additional port 164 in the cylinder 78 of power unit 74 generally adjacent the end of cylinder 78 remote from end wall 140. The port 164 opens into a retract chamber 166 defined within the cylinder 78 between the piston 132 on the one hand and an end wall 168 of the cylinder 78 on the other hand. A stop shoulder 170 on the piston 132 is adapted to abuttingly engage the end wall 168 when the rod portion 96 is fully extended whereby to define the limit of such extension of rod portion 96. It will be appreciated as illustrated in phantom lines in FIG. 9 that when the piston 132 is in its full extension position, it stops short of the port 164 so as to leave the latter in open communication with the retract chamber 166.

A pair of transverse ports 172 pass through the piston 132 in the proximal regions of the rod portion 96 to communicate the retract chamber 166 with the annular passage 130. Passage 130 in turn communicates at its opposite end with a transverse conduit 176 in the block 120. Conduit 176 is in turn alternately connectable with a source of pressurized fluid and a drain in the same manner as the conduit 124 is alternately connectable with a source of pressurized fluid and a drain.

Returning now to FIG. 1, it will be noted that the various hydraulic power units thus far described in connection with the crane of the present invention are controlled by a valve bank illustrated schematically and denoted broadly by the numeral 178. The valve bank 178 includes a plurality of valves 180 which are coupled with their respective operating power units through suitable hydraulic lines shown only schematically and in a functional sense in FIG. 1. The valves 180 in turn are operably connected with actuators 182 provided with externally disposed, hand levers (not shown) so that the valves 180 can be manually operated by a workman at ground level if desired. Preferably, the hand levers for the actuators 182 are disposed in the vicinity of the turret 10 at an external location, although they an also be located within an operating cab of the crane if desired. Hydraulic oil is operable to flow through the system under the control of the valve bank 178 when the engine of the vehicle 10 is operating, all as is customary in connection with conventional cranes.

A radio receiver 184 is operably connected with the actuators 182 for causing such actuators to operate through their various valve opening and closing motions in response to the reception of certain radio signals from a transmitter 186 located within an insulated, fiberglass, man-lifting bucket 188 attached via a swivel 190 to the outer end of the fiberglass boom 64. The bucket 188 may in fact comprise a pair of side-by-side buckets which are preferably self-levelling.

In view of the fact that high voltage electrical transmission lines are capable of generating powerful corona effects which can seriously interfere with an impair the operating abilities of radio transmitters and receivers, it is necessary for the transmitter 186 within bucket 188 to be capable of satisfactorily dealing with such corona effects. One suitable radio transmitter and receiver in this respect may be obtained from American Northwest, Inc. of Las Vegas, Nev. under their trade designation SYSTEM THREE and Model Nos. SY3-LS-RF-12-8-LV1A-K-BB or SY3 L1 DMRV-12 (-8) RF 450.470.

OPERATION

The first two sections 26 and 28 function in the usual manner of a crane, moving through their various articulating movements and rotational motions. Additionally, the booms 46, 48 and 50 of section 28 may be telescoped relative to one another to the extent desired.

A workman carried within the bucket 188 can control such movements via the transmitter 186 likewise carried within the bucket 188, as well as the articulation of third section 30 and the telescoping movement of its booms 60, 62 and 64. Consequently, the workman can himself have complete control over his vertical and horizontal positioning, all without the presence of an electrically conductive path to ground potential such as might otherwise be present through the use of control cables, wires and conduits. It will be pointed out in this respect, however, that hand levers (not shown) associated with the various actuators 182 of valve bank 178 can override the control functions exerted by the transmitter 186 such that an additional workman stationed alongside or on the vehicle 10 at ground level for safety purposes can operate manually any and all of the levers associated with the actuators 182.

FIG. 2 illustrates the section 30 in a fully retracted condition. This corresponds to the condition of the power units 74 and 76 illustrated in FIG. 9. When pressurized fluid is introduced into the conduit 124 associated with the block 120, it will be appreciated that such pressurized fluid enters the passage 126 and flows along the length of the latter, exiting the piston 132 through bore 136. The pressurized fluid moves on through the extension chamber 138, port 142 and line 144 to enter the extension chamber 150 of power unit 76 via the port 146. As shown in FIG. 9, the internal diameter of the cylinder 80 (and thus the extend chamber 150) exceeds that of the cylinder 78 (and extend chamber 138). Consequently, even though the fluid pressures are equal in the two cylinders 79, 80 at this time, the force applied against piston 152 exceeds that applied against piston 136, and the rod portion 92 extends first, forcing the fiberglass boom 64 outwardly as illustrated in FIG. 3. Once the rod portion 92 reaches the full limit of its stroke as determined by the stop shoulder 162 engaging the end wall 154, the back pressure within the extension chamber 138 of power unit 74 bears against the proximal surface of the piston 132 and the end wall 140 to cause the cylinder 78 to extend relative to the rod portion 96. This movement is illustrated in FIG. 4 wherein it will be seen that extension of the cylinder 78 causes extension of the second boom 62. Return fluid from the retract chambers 156 and 166 moves to the drain via ports 172, passage 130 and conduit 176. Thus, the fiberglass boom 64 fully extends before any extension of the steel boom 62 occurs, assuring that the workmen within the bucket 188 will be fully and adequately spaced from electrically conductive surfaces associated with the boom 62 and other structure of the crane.

When retracting the telescoping section 30, oil under pressure enters the conduit 176 while the other conduit 124 is connected to the drain. Thus, the pressurized oil moves through the passage 130 and into the retract chamber 166 via the ports 172 when the piston 132 is fully retracted to its dotted line position as illustrated in FIG. 9, causing the pressurized fluid to immediately pass through the port 164 and enter the retract chamber 156 of unit 76 via line 160 and port 158.

However, such entry of pressurized fluid into the retract chamber 156 of power unit 76 does not result in immediate retraction of the piston 152. Instead, because the surface area of end wall 168 within retract chamber 166 of power unit 74 exceeds the surface area of piston 152 exposed to pressurized fluid within retract chamber 156 of power unit 176 (as shown in FIG. 9 the annular retract chamber 166 has a larger cross-sectional area than the annular retract chamber 156), the power unit 74 operates before the power unit 76 even though at that time the units are exposed to equal pressures. In this respect, then, the cylinder 78 of power unit 74 becomes retracted relative to the rod portion 96 thereof, pulling the second boom 62 fully within the first boom 60 thereof. Only upon full retraction of the rod portion 96 into the cylinder 78 as determined by the piston 132 abutting the end wall 140 does any movement on the part of the power unit 76 occur. Thereupon the pressure within the retract chamber 156 becomes high enough to cause the rod portion 92 to retract, pulling with it the fiberglass boom 64. It will be appreciated that during such retraction of the pistion 152 of power unit 76 the oil from extension chamber 150 is forced outwardly through the port 146 and line 144, entering the port 142 of power unit 74 and ultimately flowing back to the drain via the conduit 124 in block 120.

As a consequence of the foregoing sequence of extension and retraction motions, it is assured that the fiberglass boom 64 will always extend first and retract last, maximizing the extent of safety afforded to the workmen within the bucket 188.

It will also be appreciated that the self-adjusting support 100 associated with the rod portion 96 of power unit 76 remains in a stowed position as illustrated in FIGS. 2 and 3 until after the fiberglass boom 64 has been fully extended and the second boom 62 commences its extension. Upon such extension of the second boom 62, the support 100 initially remains in its endmost position of FIGS. 2 and 3 as lost motion is used up by the elements 112 slipping through their respective shoulders 116. Once such lost motion is fully used up and the stops 118 come into abutment with the shoulder 116, the support 100 thereafter becomes pulled along with the extending boom 62 and slides along the rod portion 96 away from the anchor point 98 until the second boom 62 is fully extended as illustrated in FIG. 4. Return of the support 100 to its initial stowed position is a simple reversal of the foregoing procedure.

It will thus be seen that the foregoing specification sets forth a unique and significant improvement to the man-lifting aerial apparatus art, permitting a workman to be raised and maneuvered into hard to reach places with a maximum of security and safety. At the same time, high voltage electrical transmission apparatus and equipment may be serviced by such workmen without fear of dangerous electrical shock. Accordingly, it is to be appreciated that various minor modifications can be made to the foregoing invention without departing from the spirit and gist hereof, and the scope of the present invention should be limited only by a fair reading of the claims which follow.

We claim:

1. An electrically insulated, articulated, man-lifting aerial crane for use in servicing overhead high-voltage electrical transmission lines and the like comprising:

a vehicle providing an elevated, mobile base;

selectively operable, ground-engageable outrigger means associated with the vehicle for stabilizing the base during use;

a turret mounted on said base for selective rotary movement about a generally upright axis;

a first boom section pivotally coupled with said turret for up-and-down swinging movement;

a second boom section pivotally coupled with the first section adjacent the outer end of the latter for up-and-down swinging movement;

a third boom section pivotally coupled with said second boom section adjacent an outer end of the latter for up-and-down swinging movement, said third section including:

a first tubular boom;

a second tubular boom telescopically housed within said first boom;

a third boom telescopically housed within said second boom, said third boom being constructed of a dielectric matrerial capable of avoiding the transmission of electrical energy along the length thereof;

power means operably coupled with said booms of the third section for telescopically extending and retracting the same; and a man-carrier coupled with said third boom adjacent said outer end of the latter for transporting a workman to and from an overhead electrical transmission line during operation of the crane and maintaining the workman electrically insulated from ground potential, said power means being provided with control structure operable to always cause extension of said third boom to a fully extended position thereof before extension of said second boom whereby to place an outer end of the third boom at a remote location relative to the first and second booms prior to allowing extension of the second boom, said control structure further being operable to always cause retraction of the second boom into the first boom before retraction of the third boom into the second boom whereby to maintain said outer end of the third boom at said remote location until the second boom is first fully retracted.

2. A man-lifting crane as claimed in claim 1, wherein said second boom is constructed of a metal capable of transmitting electrical energy along the length thereof.

3. A man-lifting crane as claimed in claim 1, wherein said power means includes a pair of double-acting, fluid-pressure operated, piston and cylinder units operably coupled with said booms of the third section, control structure including a hydraulic circuit capable of supplying pressurized fluid to both of said units simultaneously, said circuit and said units being configured and arranged to fully extend the piston of the unit for said third boom before extending the piston of the unit for the second boom.

4. A man-lifting crane as claimed in claim 3, wherein said cylinders of the units are rigidly interconnected in relatively inverted, side-by-side relationship and are anchored to the second boom of the third section, the piston of the unit for the second boom being anchored to the first boom and the piston of the unit for the third boom being anchored to the third boom, said circuit including a passage through the piston of the unit for the second boom alternately communicating an internal extend operating chamber of the unit for the second boom with a source of fluid pressure and a drain, said extend chamber of the unit for the second boom having a port communicating said extend chamber with an extend operating chamber of the unit for said third boom to subject the piston of the unit for the third boom to said source of fluid pressure simultaneously with the piston of the unit for the second boom, said piston of the unit for the third boom having greater surface area exposed to said source of pessure than the piston of the unit for the second boom, said unit for the third boom having stop means for limiting the length of extension of the piston of the unit for the third boom to a certain predetermined amount, the fluid in said extend chamber of the unit for the second boom being operable to extend the piston of the unit for the second boom when the piston of the unit for the third boom has been stopped by said stop means at the full limit of its extension stroke.

5. A man-lifting crane as claimed in claim 4, wherein said piston of the unit for the second boom includes a second passage therein communicating a retract operating chamber on an opposite side of the piston of the unit for the second boom from the extend chamber thereof alternately with said source of fluid pressure and a drain in opposite sequence with communication of said extend chamber of the unit for the second boom with the source of fluid presure and a drain, said retract chamber of the unit for the second boom having a port simultaneously communicating the same with a retract operating chamber in said unit for the third boom on the opposite side of the piston from the extend chamber thereof, said piston of the unit for the second boom having a greater surface area on the retract chamber side thereof than said piston of the unit for the third boom on its retract chamber side whereby to cause the piston of the unit for the second boom to retract before the piston of the unit for the third boom, said unit for the second boom having stop means for limiting the extent of retraction of the piston of the unit for the second boom to a certain predetermined amount, the fluid in the retract chamber of the unit for the third boom being operable to retract the piston of the unit for the third boom when the piston of the unit for the second boom has been stopped by said stop means thereof at the full extent of its retraction stroke.

6. A man-lifting crane as claimed in claim 5, wherein said piston of the unit for said second boom includes a rod portion, said passages extending longitudinally within said rod portion in mutually concentric relationship.

7. A man-lifting crane as claimed in claim 6, wherein said passage for the extend chamber of the unit for the second boom is housed within the passage for the retract chamber thereof, said port of the extend chamber of the unit for the second boom being in an end of said cylinder of the unit and said port of the retract chamber of the unit for the second boom being in a sidewall of the cylinder of the unit.

8. A man-lifting crane as claimed in claim 7, wherein said passage for the extend chamber of the unit for the second boom communicates with its extend chamber through an opening in the extend chamber side of its piston, said passage for the retract chamber of the unit for the second boom communicating with its retract chamber through a lateral opening in said rod portion of the unit for the second boom.

9. A man-lifting crane as claimed in claim 8, wherein said units are disposed interiorly of said booms of the third section.

10. A man-lifting crane as claimed in claim 3, wherein said units are disposed interiorly of said booms of the third section and are rigidly interconnected in relatively inverted, side-by-side relationship, the piston of the unit for the second boom being anchored to the first boom and the piston of the unit for the third boom being anchored to the third boom, the cylinders of said units being anchored to the second boom.

11. An electrically insulated, articulated, man-lifting aerial crane for use in servicing overhead high-voltage electrical transmission lines and the like comprising:

a vehicle providing an elevated, mobile base;

selectively operable, ground-engageable outrigger means associated with the vehicle for stabilizing the base during use;

a turret mounted on said base for selective rotary movement about a generally upright axis;

a first boom section pivotally coupled with said turret for up-and-down swinging movement;

a second boom section pivotally coupled with the first section adjacent the outer end of the latter for up-and-down swinging movement;

a third boom section pivotally coupled with said second boom section adjacent an outer end of the latter for up-and-down swinging movement, said third section including:

a first tubular boom;

a second tubular boom telescopically housed within said first boom;

a third boom telescopically housed within said second boom, said third boom being constructed of a dielectric material capable of avoiding the transmission of electrical energy along the length thereof;

power means operably coupled with said booms of the third section for telescopically extending and retracting the same; and a man-carrier coupled with said third boom adjacent said outer end of the latter for transporting a workman to and from an overhead electrical transmission line during operation of the crane and maintaining the workman electrically insulated from ground potential, said power means being provided with control structure operable to cause extension of said third boom to a fully extended position thereof before extension of said second boom whereby to place an outer end of the third boom at a remote location relative to the first and second booms prior to allowing extension of the second boom, said control structure further being operable to cause retraction of the second boom into the first boom before retraction of the third boom into the second boom whereby to maintain said outer end of the third boom at said remote location until the second boom is first fully retracted, said power means including a pair of double-acting, fluid-pressure operated, piston and cylinder units operably coupled with said booms of the third section, control structure including a hydraulic circuit capable of supplying pressurized fluid to both of said units simultaneously, said circuit and said units being configured and arranged to fully extend the piston of the unit for said third boom before extending the piston of the unit for the second boom, said units being disposed interiorly of said booms of the third section and being rigidly interconnected in relatively inverted, side-by-side relationship, the piston of the unit for the second boom being anchored to the first boom and the piston of the unit for the third boom being anchored to the third boom, the cylinders of said units being anchored to the second boom, said piston of the unit for the second boom of the unit for the second boom having a rod portion thereof provided with a support between the anchor point of the rod portion to the first boom and the proximal end of the cylinder of the unit to prevent bending of the rod portion during extension thereof from its cylinder, said support being reciprocable between a stowed position adjacent the anchor point of the rod portion to the first boom when the second boom is retracted and an extended position spaced away from said anchor point of the first boom when the second boom is extended.

12. A man-lifting crane as claimed in claim 11, wherein said support is provided with a lost motion connection with said second boom permitting the second boom to extend to a certain predetermined extent and the support to remain behind with the first boom until the support is thereafter pulled along the rod portion of the unit for the second boom with the second boom as the latter continues to extend.

13. A man-lifting crane as claimed in claim 12, wherein said support includes a central sleeve portion slidably receiving said rod portion of the unit for the second boom, said support further having outboard slide members slidably engaging the interior surfaces of the first boom to maintain said sleeve portion transversly fixed yet longtudinally shiftable within the first boom.

14. A man-lifting crane as claimed in claim 13, wherein said lost motion connection includes at least one elongated, rigid element fixed to the support and extending therefrom into the second boom, said second boom having a shoulder shiftably receiving said element for longitudinal reciprocation of the element through the shoulder during extension and retraction of the second boom, said element having a stop on the end thereof for abuttingly engaging the shoulder after a certain amount of extension of the second boom for causing the support to be slidably pulled by the element through the first boom and into said extended portion of the support upon continued extension of the second boom beyond said certain amount.

15. A man-lifting crane as claimed in claim 1, wherein said control structure includes fluid flow control valves, actuators for said valves, a radio signal receiver operably coupled with said actuators for operating the same in response to reception of certain radio signals and a radio signal transmitter carried by said man-lifting carrier for generating operating signals for said receiver.

16. In a boom section for an electrically insulated, man-lifting aerial device, the improvement comprising:

a first tubular boom;

a second tubular boom telescopically housed within said first boom;

a third boom telescopically housed within said second boom, said third boom being constructed of a dielectric material capable of avoiding the transmission of electrical energy along the length thereof;

power means operably coupled with said booms for telescopically extending and retracting the same;

control structure operable always to cause extension of said third boom to a fully extended position thereof before extension of said second boom whereby to place an outer end of the third boom at a remote location relative to the first and second booms prior to allowing extension of the second boom, said control structure further being operable always to cause retraction of the second boom into the first boom before retraction of the third boom into the second boom whereby to maintain said outer end of the third boom at said remote location until the second boom is first fully retracted; and a man-carrier coupled with said third boom adjacent said outer end of the latter.

17. In a boom section as claimed in claim 16, wherein said power means includes a pair of double-acting, fluid-pressure operated, piston and cylinder units operably coupled with said booms of the third section, control structure including a hydraulic circuit capable of supplying pressurized fluid to both of said units simultaneously, said circuit and said units being configured and arranged to fully extend the piston of the unit for said third boom before extending the piston of the unit for the second boom.

18. In a boom section as claimed in claim 17, wherein said units are disposed interiorly of said booms and are rigidly interconnected to relatively inverted, side-by-side relationship, the piston of the unit for the second boom being anchored to the first boom and the piston of the unit for the third boom being anchored to the third boom, the cylinders of said units being anchored to the second boom.

19. In a boom section as claimed in claim 17, wherein said cylinders of the units are rigidly interconnected in relatively inverted, side-by-side relationship and are anchored to the second boom, the piston of the unit for the second boom being anchored to the first boom and the piston of the unit for the third boom being anchored to the third boom, said circuit including a passage through the piston of the unit for the second boom alternately communicating an internal extend operating chamber of the unit for the second boom with a source of fluid pressure and a drain, said extend chamber of the unit for the second boom having a port communicating said extend chamber with an extend operating chamber of the unit for said third boom to subject the piston of the unit for the third boom to said source of fluid pressure simultaneously with the piston of the unit for the second boom, said piston of the unit for the third boom having greater surface area exposed to said source of pressure than the piston of the unit for the second boom, said unit for the third boom having stop means for limiting the length of extension of the piston of the unit for the third boom to a certain predetermined amount, the fluid in said extend chamber of the unit for the second boom being operable to extend the piston of the unit for the second boom when the piston of the unit for the third boom has been stopped by said stop means at the full limit of its extension stroke.

20. In a boom section as claimed in claim 19, wherein said piston of the unit for the second boom includes a second passage therein communicating a retract operating chamber on an opposite side of the piston of the unit for the second boom from the extend chamber thereof alternately with said source of fluid pressure and a drain in opposite sequence with communication of said extend chamber of the unit for the second boom with the source of fluid presure and a drain, said retract chamber of the unit for the second boom having a port simultaneously communicating the same with a retract operating chamber in said unit for the third boom on the opposite side of the piston from the extend chamber thereof, said piston of the unit for the second boom having a greater surface area on the retract chamber side thereof than said piston of the unit for the third boom on its retract chamber side whereby to cause the piston of the unit for the second boom to retract before the piston of the unit for the third boom, said unit for the second boom having stop means for limiting the extent of retraction of the piston of the unit for the second boom to a certain predetermined amount, the fluid in the retract chamber of the unit for the third boom being operable to retract the piston of the unit for the third boom when the piston of the unit for the second boom has been stopped by said stop means thereof at the full extent of its retraction stroke.

21. In a boom section as claimed in claim 20, wherein said piston of the unit for said second boom includes a rod portion, said passages extending longitudinally within said rod portion in mutually concentric relationship.

22. In a boom section as claimed in claim 21, wherein said passage for the extend chamber of the unit for the second boom is housed within the passage for the retract chamber thereof, said port of the extend chamber of the unit for the second boom being in an end of said cylinder of the unit and said port of the retract chamber of the unit for the second boom being in a sidewall of the cylinder of the unit.

23. In a boom section as claimed in claim 22, wherein said passage for the extend chamber of the unit for the second boom communicates with its extend chamber through an opening in the extend chamber side of its piston, said passage for the retract chamber of the unit for the second boom communicating with its retract chamber through a lateral opening in said rod portion of the unit for the second boom.

24. In a boom section for an electrically insulated, man-lifting aerial device, the improvement comprising:

a first tubular boom;

a second tubular boom telescopically housed within said first boom;

a third boom telescopically housed within said second boom, said third boom being constructed of a dielectric material capable of avoiding the transmission of electrical energy along the length thereof;

power means operably coupled with said booms for telescopically extending and retracting the same;

control structure operable to cause extension of said third boom to a fully extended position thereof before extension of said second boom whereby to place an outer end of the third boom at a remote location relative to the first and second booms prior to allowing extension of the second boom, said control structure further being operable to cause retraction of the second boom into the first boom before retraction of the third boom into the second boom whereby to maintain said outer end of the third boom at said remote location until the second boom is first fully retracted; and a man-carrier coupled with said third boom adjacent said outer end of the latter, said power means including a pair of double-acting, fluid-pressure operated, piston and cylinder units operably coupled with said booms of the third section, control structure including a hydraulic circuit capable of supplying pressurized fluid to both of said units simultaneously, said circuit and said units being configured and arranged to fully extend the piston of the unit for said third boom before extending the piston of the unit for the second boom, said units being disposed interiorly of said booms and being rigidly interconnected in relatively inverted, side-by-side relationship, the piston of the unit for the second boom being anchored to the first boom and the piston of the unit for the third boom being anchored to the third boom, the cylinders of said units being anchored to the second boom, said piston of the unit for the second boom having a rod portion thereof provided with a support between the anchor point of the rod portion to the first boom and the proximal end of the cylinder of the unit to prevent bending of the rod portion during extension thereof from its cylinder, said support being reciprocable between a stowed position adjacent the anchor point of the rod portion to the first boom when the second boom is retracted and an extended position spaced away from said anchor point of the first boom when the second boom is extended.

25. In a boom section as claimed in claim 24, wherein said support is provided with a lost motion connection with said second boom permitting the second boom to extend to a certain predetermined extent and the support to remain behind with the first boom until the support is thereafter pulled along the rod portion of the unit for the second boom with the second boom as the latter continues to extend.

26. In a boom section as claimed in claim 25, wherein said support includes a central sleeve portion slidably receiving said rod portion of the unit for the second boom, said support further having outboard slide members slidably engaging the interior surfaces of the first boom to maintain said sleeve portion transversly fixed yet longtudinally shiftable within the first boom.

27. In a boom section as claimed in claim 26, wherein said lost motion connection includes at least one elongated, rigid element fixed to the support and extending therefrom into the second boom, said second boom having a shoulder shiftably receiving said element for longitudinal reciprocation of the element through the shoulder during extension and retraction of the second boom, said element having a stop on the end thereof for abuttingly engaging the shoulder after a certain amount of extension of the second boom for causing the support to be slidably pulled by the element through the first boom and into said extended portion of the support upon continued extension of the second boom beyond said certain amount.

* * * * *